United States Patent [19]

Cook et al.

[11] Patent Number: 4,747,273

[45] Date of Patent: May 31, 1988

[54] HEATING AND COOLING SYSTEM

[75] Inventors: Robert E. Cook, Kankakee, Ill.; Michael J. Davidson, West Lafayette, Ind.; Maurice A. Rice, Cincinnati, Ohio

[73] Assignee: Artesian Building Systems, Lafayette, Ind.

[21] Appl. No.: 22,075

[22] Filed: Mar. 5, 1987

[51] Int. Cl.[4] ..... F25B 27/00

[52] U.S. Cl. ..... 62/238.6

[58] Field of Search ..... 62/79, 238.6, 238.7

[56] References Cited

U.S. PATENT DOCUMENTS

| | | | |
|---|---|---|---|
| 2,668,420 | 2/1954 | Hammell | 62/238.6 X |
| 2,696,085 | 12/1954 | Ruff | 62/238.6 X |
| 3,017,162 | 1/1962 | Haines et al. | 62/238.6 X |
| 4,142,379 | 3/1979 | Kuklinski | 62/238.6 X |
| 4,281,519 | 8/1981 | Spath et al. | 62/238.6 X |
| 4,293,323 | 10/1981 | Cohen | 62/238.6 |
| 4,299,098 | 11/1981 | Derosier | 62/238.6 |
| 4,315,597 | 2/1982 | Garraffa, Jr. | 62/238.6 X |
| 4,356,706 | 11/1982 | Baumgarten | 62/238.6 |
| 4,399,664 | 8/1983 | Derosier | 62/238.7 |
| 4,528,822 | 7/1985 | Glamm | 62/238.7 |

*Primary Examiner*—Lloyd L. King

*Attorney, Agent, or Firm*—Neuman, Williams, Anderson & Olson

[57] ABSTRACT

An improved heating and cooling system for an associated home or office environment is provided which facilitates efficiency and enhances overall system operation. The operative elements of the heating and cooling system including a compressor, desuperheater, pump, water heater tank, blower, heat exchange unit and central electrical control unit are all contained in a single, common cabinet providing thermal and noise insulation and drain pan-spillage containment. Ambient and standby thermal loss is minimized by reason of the cabinet and the proximity of the operative elements therein. Facilitation of the desuperheating function is further provided through defining three distinct water temperature layers within the water heater tank and maintaining predetermined water temperatures within those layers through selective operation of the desuperheater and a bypass arrangement. Internal temperature maintenance in the associated home or office environment is further facilitated through cut-off of the desuperheater function when maximal heat transfer to the environment is desired. Optimization of the energy imparted by water heating elements within the water heater tank provides for improved overall efficiency and reduced operating costs.

19 Claims, 1 Drawing Sheet

HEATING AND COOLING SYSTEM

BACKGROUND OF THE INVENTION

The present invention relates generally to the heating and cooling system art. More particularly, the present invention provides an improved system for heating and cooling as well as water heating having increased overall efficiency and enhanced operating parameters.

Traditionally, heating and cooling system components have been placed at various locations in the home or commercial establishment where they may be out of the way or convenient for service. With the advent of air conditioning systems and heat pumps, or heat exchange systems, energy in the form of heat is transferred to or from the indoor envelope to or from the exterior heat exchanger. Heat removed from the interior envelope was commonly wasted to the outdoor environment. In response, some systems now capture a portion of the excess heat generated by the exhaust gases from the compressor to provide a boost to other portions of the system, for example, the water heater. Although partially successful, no present, commercially available system has yet met the expectations of improvement in overall system efficiency, while maintaining convenient and practical system operation.

SUMMARY AND OBJECTS

Accordingly, it is a principal object of the present invention generally to overcome the deficiencies present in the prior art.

It is a further object to provide an improved heating and cooling system having increased overall system efficiency.

It is still a further object to provide a practical, working system having reliable operation, increased overall efficiency and convenient and compact construction.

Yet another object is to provide a system with long term cost savings on the system operation.

Further and additional objects will appear from the description, accompanying drawings and appended claims.

One novel feature of the present invention resides in the enclosure of the operative system elements and components within a single, insulated cabinet to minimize ambient temperature/heat loss among the system elements and components. At least the system compressor, air blower, indoor heat exchanger and water heater share a common cabinet having desired thermal and noise insulation and system isolation characteristics. In the preferred embodiment, this allows optimization of heat transfer from the compressor exhaust gas to the water heater, while also allowing easy, convenient access for servicing. Further, this system approach allows all elements and components thereof to be suitably matched and adjusted when assembled at the factory and to be governed by a central electrical control unit for further performance optimization. Containment of the system elements and components within a common housing further allows utilization of a bypass means with a minimal addition of cost and tubing. Use of the bypass means to maintain circulation in the desuperheater tubing, when additional heat removal from the compressor exhaust gases is undesired, preserves tubing integrity and minimizes deposits or encrustations on the tubing interior surfaces.

Additional features of the preferred embodiment provide for a discharge of the heated water at an intermediate, selected point within the water heater tank which in turn facilitates efficient system operation. This intermediate discharge creates three identifiable temperature layers within the water heater tank, which in turn minimizes the temperature of the water passing to the heat recovery loop. This maximizes heat transfer from the compressor exhaust gases, and also minimizes the additional heat energy which the water heater element must supply to raise the water to the desired outlet temperature. The heat recovery loop design and use of a dispersement attachment to diffuse the entering water into a relatively non-turbulent state maintains the three layers within the water heater tank and minimizes undesired mixing between the layers as a result of circulation through the heat recovery loop.

BRIEF DESCRIPTION OF THE FIGURES

The features of the present invention are set forth with particularity in the appended claims. Certain aspects of the invention have been indicated in the foregoing introduction and summary. Other and further objects, features and advantages will be apparent, to those skilled in the art, in the following detailed description taken in conjunction with the accompanying drawings. In particular, each of the appended claims may be taken as expressing objects and features of the present invention and both when viewed as a whole and when considered as to individual recited features and as to feature interrelationships. The following general description and the relation of the various features of the invention may be further understood by reference to the accompanying drawings in which like reference numerals have been utilized to indicate like elements, and of which:

DETAILED DESCRIPTION OF PREFERRED EMBODIMENTS

Figure 1:
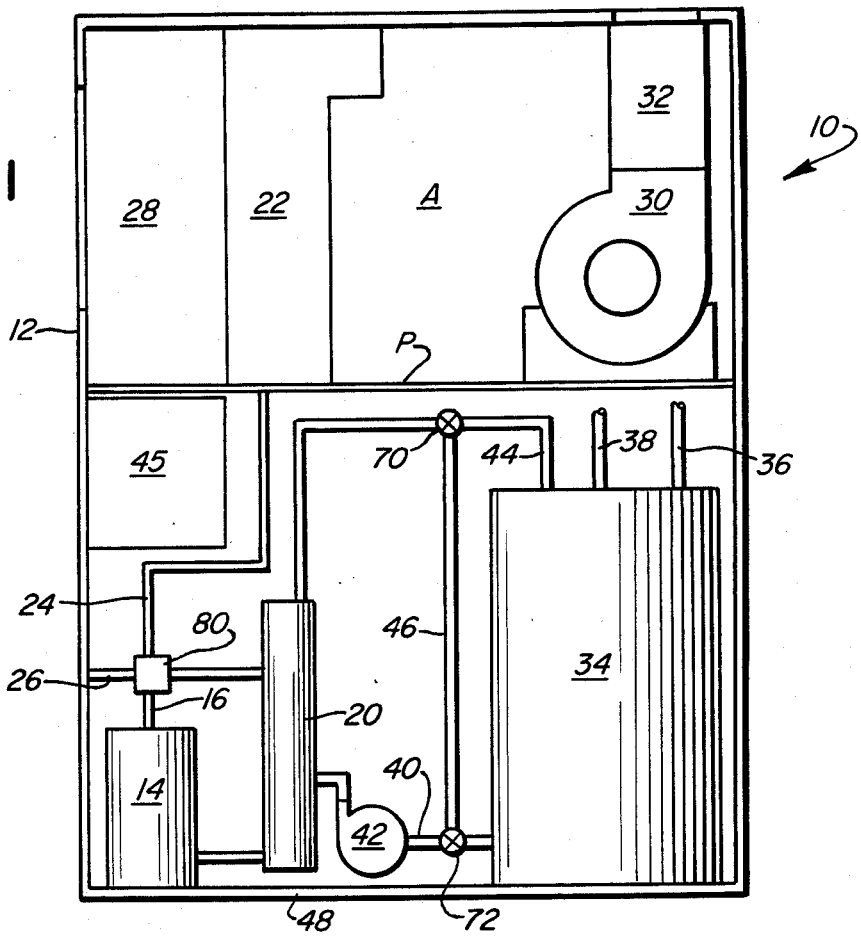
FIG. 1 is a general block diagram illustration of the elements and components of the improved heating and cooling system of the present invention which are enclosed within the single cabinet or housing unit.

Referring now to the drawings, FIG. 1 illustrates a general representation of an improved heating and cooling system 10 according to the present invention. The heating and cooling system 10 generally comprises a number of elements and components enclosed within a single cabinet or housing unit 12, which is shown in FIG. 1 with a front panel or cover removed so as to reveal the various internal elements and components. Generally, a compressor 14 operates on refrigerant gas received via a conduit 16, see FIG. 1. In one mode, conduit 16 is connected to and fed refrigerant via conduit 26 from an outside heat exchanger, not shown. The resulting gas is compressed by compressor 14 and is then passed to the desuperheater 20 (sometimes referred to as a waste heat recovery or reclaim unit) via conduit 18. Leaving the desuperheater 20, the gas is passed to an indoor heat exchanger 22 via conduit 24. In an alternate mode, the compressor 14 also receives refrigerant from conduit 16 which is connected to and fed refrigerant via conduit 24 from the indoor heat exchanger 22. The exhaust gases from the compressor 14 may be passed from the desuperheater 20 either to the indoor heat exchanger 22 via a conduit 24 or again to the outside heat exchanger via conduit 26. This refrigerant control is provided by a valve 80 and is governed by either a demand for heating or a demand for cooling. In such an arrangement, air returned via an air return section 28 may be heated or cooled as desired by exchanger 22 and passed through a blower 30 to a forced air outlet section 32 and then into the home or office interior to provide desired heating or cooling thereof.

Additionally, as shown in FIG. 1, a water heater tank 34 is provided which receives cold water via an inlet pipe 36 and provides hot water out via an outlet pipe 38. In the preferred embodiment, as illustrated, the tank 34 provides water via another outlet pipe 40 which is circulated by a pump 42 through the desuperheater 20 in which additional energy may be imparted to the circulated water prior to the latter being returned to the water heater tank 34 through a pipe 44, see FIG. 2. Additionally, bypass tubing 46 may be included for shunting a predetermined amount of the water circulated through the desuperheater 20 from the water heater tank in response to preselected conditions within the water heater tank 34 or within other portions of the heating and cooling system 10.

An electrical control unit 45 is disposed within cabinet 12 and provides a centralized, readily accessible means for controlling each of the various elements and components of the heating and cooling system 10.

As noted in FIG. 1, the air return 28, indoor heat exchanger 22, blower 30 and air outlet 32 are located within a compartment A which in turn is segregated from the remainder of the interior of cabinet 12 by a partition P.

In addition to these aforenoted elements and components, compressor 14, desuperheater 20, water heater tank 34 and associated components are also enclosed within single cabinet 12 thus, resulting in increased efficiency in the heating and cooling system 10. In the preferred embodiment, cabinet 12 comprises insulated walls which operate to maintain the ambient temperature within the cabinet and minimize heat loss to the exterior. Additionally, the cabinet walls provide a desired noise shield which allows all the elements of the system 10 to operate without undue distraction in the home or office environment. Further, the base portion 48 of cabinet 12 forms a drain pan which provides protection against unwanted spillage from any of the elements or components enclosed within the cabinet.

Spillage may originate from at least four sources within the cabinet 12: (i) the heat exchanger 22; (ii) the compressor 14; (iii) the water heater 34; and (iv) the waste heat recovery components (e.g., the desuperheater 20, the pump 42 and assorted valves and fittings). The base portion 48 thus forms a drain pan to catch unwanted spillage in such instances as primary drain stoppage on the heat exchanger 22 or "carryover" at the heat exchanger 22 (high air velocity carries droplets of condensation from the heat exchanger into the area A).

By containment of all of the operative elements and components of the system 10 within cabinet 12, they are maintained in close proximity to one another thereby minimizing heat loss in the various conduits from the compressor 14, which in turn optimizes the available heat energy for exchange with the circulating water within the desuperheater 20. Additionally, even when desuperheater 20 is not being used to provide a heating boost to the water within the water heater tank 34, the close proximity of the compressor 14 to the indoor heat exchanger 22 optimizes the heat which may be utilized to increase the temperature of the circulating air returned through the air return section 28 and discharged by blower 30 through the forced air outlet 32.

As with other systems, provision may be made for locating a filter upstream of the heat exchanger 22. Also, a humidifier function may be added in conjunction with blower 30.

Grouping all the aforenoted operational elements and components of the system 10 and electrical control unit 45 within the cabinet 12 provides for optimization of the operating characteristics of each of the separate elements and components. In this fashion, each element or component may be matched to other elements or components of the system in a single package at the factory rather than by hit-or-miss adjustments on site. Additionally, each of the components may be allowed to operate more efficiently without additional insulation enclosing same.

Figure 2:
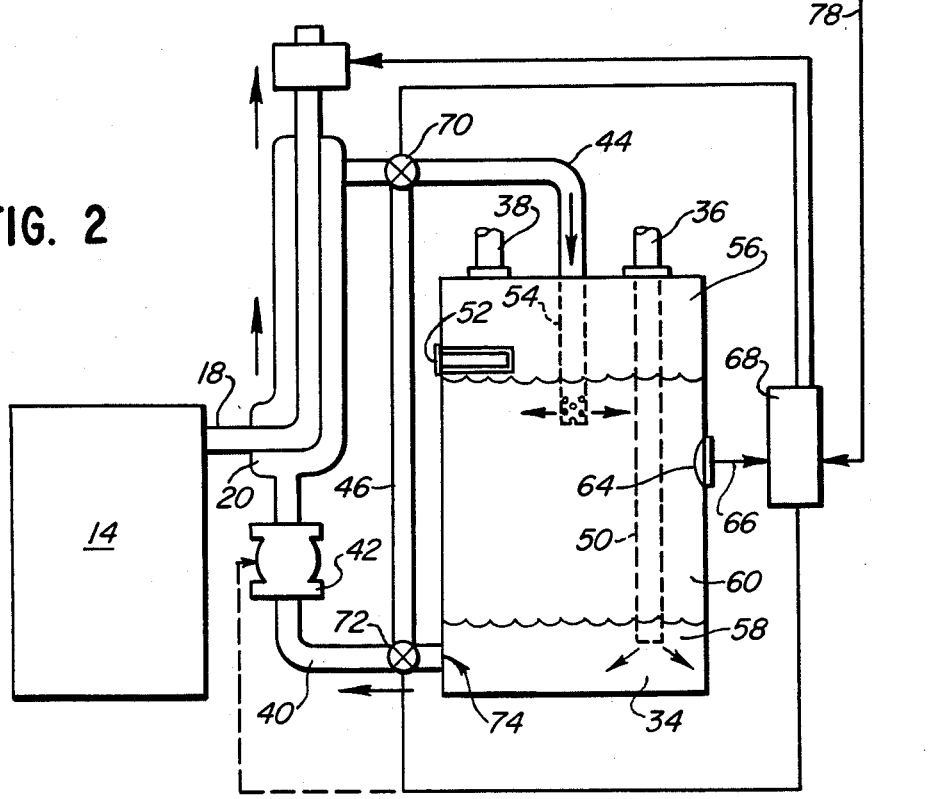
FIG. 2 is a fragmentary enlarged representative diagram of particular portions in cross section of the system of the present invention and showing the three distinctive layers within the water heater tank and also the heat recovery loop.

While FIG. 1 illustrates some general concepts and novelties of the present invention, FIG. 2 illustrates a further embodiment which may be applicable in the preferred system.

Generally, FIG. 2 illustrates a water heater tank 34 having a cold water inlet pipe 36 and a hot water outlet pipe 38. Additionally, water which has been circulated through an outlet 74, pipe 40, pump 42, and desuperheater 20, is returned to the tank 34 through pipe 44. An additional common element within cabinet 12 is a compressor outlet conduit 18, which is illustrated as passing to the outdoor coil for cooling purposes and to the indoor heat exchanger (heating coil) for heating purposes. Also, bypass tubing 46 is disposed within the cabinet 12 and allows the water circulating through the desuperheater 20 to circumvent water heater 34 in response to various conditions, such as the temperature of the water in various layers within water heater tank 34 and/or the temperature within the home or office space being heated or cooled, as discussed more fully hereinafter.

As shown in FIG. 2, the water heater tank 34 receives cold water from inlet pipe 36 through an inlet extension 50 which is disposed within the tank and terminates near the bottom of the tank. In the preferred embodiment, the outlet of the cold water extension 50 is approximately six inches from the tank bottom. In operation, the cold water extension 50 creates a defined cold water layer 58 near the bottom of the water heater tank 34 which in the preferred embodiment has a temperature of approximately 50° to 70° F. At least one water heating means 52 (e.g., electrically energized element) is preferably located within the top one-third of the water heater tank and creates a hot water layer 56 within the top third of the tank. The water in the top third of the tank which is withdrawn through outlet 38, may have a temperature (e.g., 140° F.) for service within the home or office area.

As mentioned previously, water from the cold water layer 58 at the bottom of the tank is withdrawn through pipe 40 into pump 42 and then into desuperheater 20. Within the desuperheater 20, the cold water circulating therein removes at least some portion of the heat energy from the exhaust gases passing through the conduit 18 from the compressor 14. The heated water circulating within the desuperheater 20 returns to the water heater tank through pipe 44. Pipe 44 may be fitted with an inlet extension 54 which discharges the heated water from the desuperheater 20 into a portion of the tank intermediate the hot water layer 56 and the cold water layer 58. The immersed end of extension 54 may be provided with a suitable device 54 which diffuses the discharged heated water in a relatively non-turbulant state, thereby minimizing intermixing of the discharged water in layer 60 with the water in adjacent layers 56 and 58.

Thus, the first layer 56 of water is distinctly defined near the top of the tank from which hot water is withdrawn through the outlet 38. The second layer 58 of water is distinctly established near the base of the tank and has a temperature approximately equal to that of the cold water received through the cold water inlet pipe 36. The third layer of water 60 established intermediate the first and second layers 56 and 58 will have a temperature corresponding to that of the water which has been circulated through the desuperheater 20. In the preferred embodiment, these three layers provide advantages and improved efficiency to the overall system. Correspondingly, in the preferred embodiment, the heated water returning through the inlet extension 54 is desirably dispersed directionally in a generally lateral fashion by device 54 through the intermediate third layer 60 without causing excessive mixing thereof with the adjacent layers within the tank. Desired mixing between the layers occurs when service hot water is drawn from the first layer 56 out the outlet 38 and is replaced by additional cold water from inlet 36.

The present invention envisions that the three layers provide unique advantages. Specifically, the cold water near the base of the water heater tank 34, which may be pulled by the pump 42 through the pipe 40 and into the desuperheater 20, will provide a minimum water temperature for the water entering the desuperheater 20 and a maximum temperature differential between the exhaust gases passing through the conduit 18 and the water circulating within the desuperheater 20. It is envisioned that this will maximize the heat transfer from the exhaust gases within the conduit 18 to the water circulating through the desuperheater 20. A corresponding increase in the efficiency of the cooling function of the system may then be expected. The heated water passing back to the water heater tank through the pipe 44 thus will receive appreciable heat energy to raise its temperature above that of the cold water in the layer 58, thereby creating the third layer 60.

Maintenance of the hot water temperature layer 56 near the hot water outlet 38 facilitates a ready supply of hot water for service to the home or office utilizing the system of the present invention. This minimizes the amount of energy which must be imparted to the outgoing hot water by the electrical water heating element 52. Maintenance of the third layer 60, intermediate the first layer 56 and the second layer 58, at some intermediate temperature within the water system minimizes the amount of energy which the heating means 52 must impart to the water to raise it to the desired temperature within the first layer 56 for service via the hot water service outlet 38. Thus, the excess energy from the exhaust gases in conduit 18 is tapped in a highly efficient manner, minimizing the operation time of the heating means 52.

However, conditions may be encountered in which operation of the heat recovery system to provide a further energy boost to the water within the water heater tank 34 may be undesirable. A first such condition which may be encountered correlates with the desired maintenance of the intermediate layer between the hot and cold layers. Thus, a temperature sensor, or thermostat, 64 may be included to monitor the temperature within the third layer 60. When the sensor 64 records a temperature within the third layer 60 in excess of the desired maximum temperature for that layer, an output signal on a line 66 to a control circuit unit 68 selectively actuates the controller to prevent further circulation of the heated water into the water heater tank 34 and cold water out of the second layer 58. In the illustrative embodiment of FIG. 2, solenoid valves 70 and 72 may be utilized or a single three way valve, not shown, may be substituted therefor preferably disposed at valve 70 location, see FIG. 2, for preventing further discharge of heated water through pipe 44 and the intake of cold water from the layer 58 via a port 74 by shunting the water circulating in the desuperheater 20 past the water heater tank via the bypass tubing 46. In such an arrangement, the operation of the pump 42 provides continued circulation of the water through the desuperheater 20, which prevents water from stagnating within the desuperheater 20 even though an additional heating boost is no longer desired to the water within the water heater tank. This further minimizes the deposits or encrustations of minerals and other substances on the interior surfaces of the hot tubing utilized within the desuperheater 20. Accordingly, long term operation of the system may be facilitated with minimal servicing.

Containment of the heating and cooling system within the single cabinet illustrated in FIG. 1 further facilitates this operation through a minimization of the length of tubing required to complete the heat recovery loop both for providing a boost to the water within the tank 34 and for allowing the bypass or the shunting of the water through the bypass tubing 46.

At other times, it may become undesirable to drain excess energy from the exhaust gases within the conduit 18 while heating is desired in the home or office space. A room sensor 76 may be further connected to the control circuit unit 68. When the room sensor 76 (e.g., thermostat) determines that the room temperature has fallen below a selected value or when it is determined that more space heating energy is needed for proper operation of the system during a heating mode, it may provide a signal via line 78 to the control circuit unit 68 to again actuate the solenoid valves 70 and 72 and shunt the water circulating through the desuperheater 20 through the bypass tubing 46 and prevent further discharge into the water heater tank. This effectively prevents further drain of the heat value within the desuperheater 20 from the exhaust gases passing through the conduit 18 to the heat exchange unit 22 (illustrated in FIG. 1). This effectively maximizes the heat energy available for heating the air returning through air return 28 and being passed out by blower 30 through the forced air outlet 32. Containment of all of the elements or components of the system within the single cabinet likewise means that bypass tubing 46 will be enclosed within that same cabinet. This will minimize the ambient or stand-by heat loss through the bypass tubing 46 during the system heating mode, thereby minimizing the heat loss through desuperheater 20 during the shunting operation aforedescribed, while still allowing water circulation to minimize desuperheater tubing maintenance.

Alternatively, the control circuit unit 68 may be triggered by either the third water temperature layer sensor 64 or the room sensor 76 to discontinue operation of the pump 42. This also will shut off further circulation of heated water when desired in which case valve 70, 72 and bypass tubing 46 will not be required. In instances where water characteristics (e.g. soft water) are such that mineral deposition as a result of stagnation is insignificant the elimination of valves 70, 72 and tubing 46 may be appropriate.

Although described above in terms of a number of preferred embodiments, the novel features of the present invention, and the interaction between such features, may be appreciated from the appended claims. Such modifications and alterations which would be apparent to one of ordinary skill in the art and familiar with the teachings of the present application are deemed to fall within the spirit and scope of the invention as set forth in those appended claims.

What we claim is:

1. An improved heating and cooling system utilizing recovered heat comprising:

a water heater having a tank provided with a cold water inlet and a hot water outlet, at least one water heating means within the tank near said outlet thereby effecting a first water temperature layer within said tank, means for effecting flow of cold water at said inlet to a region within said tank distally located from said outlet and said first water temperature layer and creating a second water temperature layer within said tank, water circulation means having an inlet communicating with said second water temperature layer, pump means coacting with said water circulation means for circulating water therein, desuperheater means for raising the temperature of water received by said circulation means from said second layer, and outlet means disposed within said tank intermediate said first and second water temperature layers creating a third water temperature layer within said tank;

compressor means for effecting heating and cooling functions within the system and having an outlet means for heated compression gases communicating with said desuperheater means and the water circulating in said water circulation means and dissipating heat from said compression gases;

heat exchange means operatively connected to said compressor means; and blower means associated with said heat exchange means to provide air flow across the heat exchange means and provide circulation of conditioned air outside a cabinet;

said blower means, heat exchange means, compressor means and tank being disposed in proximity within said cabinet the latter being insulated whereby the heat of the compression gases is substantially retained prior to reaching said desuperheater means.

2. The system of claim 1 wherein said water heater tank includes selectively operable bypass means having one end connected between said water circulation means inlet and said desuperheater means and a second end connected between said desuperheater means and said water circulation means outlet, said bypass means effecting selected circulation through said desuperheater means of the water in said circulation means without discharging same into said tank.

3. The system of claim 2 including thermostat means for sensing the temperature of said third water temperature layer, the operation of said bypass means being responsive to said thermostat means and substantially maintaining said third water temperature layer at a predetermined temperature.

4. The system of claim 2 including thermostat means for sensing the temperature at a predetermined location remote from the water heater tank and controlling operation of said bypass means to regulate heat transfer from said compression exhaust gases to the water circulating in said desuperheater means.

5. The system of claim 1 including thermostat means in operative proximity to said third water temperature layer and responsive to the temperature thereof, said thermostat means controlling operation of said pump means to substantially maintain said third water temperature layer at a predetermined temperature.

6. The system of claim 1 wherein said water circulation means includes an outlet with dispersement means (54) for minimizing intermixing of the water in said third water temperature layer with the water in either the first or second layer.

7. The system of claim 1 wherein said insulated cabinet further comprises a noise dampening means for said blower means, heat exchange means, compressor means and water heater tank.

8. The system of claim 1 wherein said insulated cabinet comprises a base portion effecting a drain pan to contain unwanted spillage from at least said heat exchange means, compressor means and water heater tank disposed within the cabinet.

9. Improved water heating apparatus for use in an integrated heating and cooling system for conditioning a space, said apparatus having at least a compressor means, heat exchange means and conduit means for transmitting compressor-processed gases to said heat exchange means comprising:

a water heater tank having a cold water inlet and a hot water outlet for water service to the said space, at least one water heating means within the tank near the hot water outlet, thereby effecting a first water temperature layer within said tank and inlet extension means coupled to said cold water inlet to discharge cold water at a region within said tank distally located from said outlet and said first water temperature layer, thereby effecting a second water temperature layer within said tank;

desuperheater means coupled proximate said conduit means for heat transfer from said compressor-processed gases to water circulating in said desuperheater means; and circulation means for selectively withdrawing water from said second water temperature layer in said tank, circulating said water through said desuperheater means and discharging said water from said desuperheater means into said tank at a region intermediate said first and second layers, thereby effecting a third water temperature layer within said tank.

10. The apparatus of claim 9 further comprising:

selectively operable bypass means having one end connected between said circulation means and said second water temperature layer and a second end connected between said circulation means and said third water temperature layer, said bypass means effecting predetermined circulation through said desuperheater means of the water in said water circulation means without discharging same into said tank.

11. The apparatus of claim 10 further including thermostat means for sensing the temperature in said third water temperature layer; the operation of said bypass means being responsive to said thermostat means and substantially maintaining the water temperature in said third layer at a selected value.

12. The apparatus of claim 10 further including thermostat means for sensing the temperature at a predetermined location and controlling operation of said bypass means to regulate heat transfer from said compressor-processed gases to the water circulating in said desuperheater means.

13. The apparatus of claim 10 further including thermostat means for sensing the temperature in said third water temperature layer; said circulation means including pump means responsive to said thermostat means and substantially maintaining the third water temperature layer at a selected temperature.

14. The apparatus of claim 10 further including thermostat means for sensing the temperature at a predetermined location and controlling operation of a pump means in said circulation means to vary water circulation through the desuperheater means.

15. The apparatus of claim 9 wherein said circulation means further comprises an outlet with dispersement means (54) for minimizing intermixing of the outlet water with the water in either of said first and second water temperature layers.

16. The apparatus of claim 9 wherein said water heater tank, said compressor means, said heat exchange means and said conduit means are disposed in proximity within a single insulated cabinet, whereby the heat of the compressor-processed gases is substantially retained prior to reaching said desuperheater means and ambient heat loss is minimized.

17. The apparatus of claim 16 wherein said insulated cabinet further comprises noise dampening means for said water heater tank, compressor means, heat exchange means and water circulation means.

18. The apparatus of claim 16 wherein said insulated cabinet further comprises a base portion effecting a drain pan to contain unwanted spillage from said water heater tank, compressor means, heat exchange means and conduit means all of which are disposed within the cabinet.

19. The apparatus of claim 16 including a control means for regulating the operation of said compressor means, blower means, water heating means and water circulation means, said control means being disposed within said cabinet.

* * * * *